United States Patent [19]

Smith

[11] Patent Number: 4,907,912

[45] Date of Patent: Mar. 13, 1990

[54] SUBMERSIBLE PRODUCTION STORAGE BARGE AND METHOD FOR TRANSPORTING AND INSTALLING A JACK-UP RIG IN A BODY OF WATER

[75] Inventor: Marvin L. Smith, Houston, Tex.

[73] Assignee: JFP Energy, Inc., Houston, Tex.

[21] Appl. No.: 253,767

[22] Filed: Oct. 5, 1988

[51] Int. Cl.[4] ..... E02B 17/02

[52] U.S. Cl. ..... 405/208; 405/210; 405/200; 405/207; 405/227; 141/82

[58] Field of Search ..... 405/210, 207, 208, 217, 405/200, 196, 203, 204, 205, 227; 141/82

[56] References Cited

U.S. PATENT DOCUMENTS

| | | | |
|---|---|---|---|
| 3,118,283 | 1/1964 | True et al. | 405/200 |
| 3,339,367 | 9/1967 | Lacy, Jr. | 405/210 |
| 3,717,001 | 2/1973 | Tam | 405/210 |
| 4,266,887 | 5/1981 | Corder | 405/208 X |
| 4,417,664 | 11/1983 | Gordon | 405/200 X |
| 4,461,599 | 7/1984 | Tanaka | 141/82 X |

FOREIGN PATENT DOCUMENTS

| | | | |
|---|---|---|---|
| 2080860 | 2/1982 | United Kingdom | 405/207 |

*Primary Examiner*—Dennis L. Taylor
*Assistant Examiner*—J. Russell McBee
*Attorney, Agent, or Firm*—Ben D. Tobor

[57] ABSTRACT

A submersible production storage barge and method for transporting and installing a jack-up rig in a body of water has the submersible production storage barge releasably secured to a jack-up rig while the jack-up rig and submersible production storage barge are towed as a unit to the desired offshore location.

16 Claims, 4 Drawing Sheets

SUBMERSIBLE PRODUCTION STORAGE BARGE AND METHOD FOR TRANSPORTING AND INSTALLING A JACK-UP RIG IN A BODY OF WATER

BACKGROUND OF THE INVENTION

1. Field of the Invention

The invention relates to a submersible production storage barge and a method for transporting and installing a jack-up rig in a body of water.

2. Description of the Prior Art

In the production of hydrocarbon fluids from offshore sites located in a body of water, such as the oceans and gulfs throughout the world, it is necessary to provide for the transportation of the hydrocarbon fluids produced from the offshore site to a site on land. Typically, such transportation is provided by bankers, both ocean-going and shuttle, which receive the hydrocarbon fluids through conventional piping from the offshore platform, and transport it to land. In some instances, the hydrocarbon fluids are pumped directly to the tanker or to shore, via a pipeline, while in other instances, the hydrocarbon fluids produced at the offshore location are stored in suitable containers at the offshore site, and the hydrocarbon fluids are subsequently transferred to the tanker.

In many instances, the offshore wells are drilled through use of a mobile offshore drilling unit, such as a jack-up rig, or a semi-submersible rig, which mobile offshore drilling unit may subsequently be used as a production facility. Such mobile offshore drilling units are typically towed to the offshore site by a vessel such as an ocean-going tugboat. In the case of a conventional jack-up rig, the jack-up rig, after having been towed to the offshore site, is associated with a pre-installed offshore platform. With respect to both the semi-submersible rigs and the jack-up rigs, it is typically necessary to provide some storage device for the hydrocarbon fluids produced, so that they may be stored prior to transfer to a tanker. It is necessary to provide for the transportation of such storage device, such as a barge or submersible storage tank, as well as is necessary to provide for the connection of the storage device to the rig by suitable piping and related rigging, whereby the produced hydrocarbon fluids may be transferred from the well to the storage device.

When the produced hydrocarbon fluids are to be directly transferred to tankers, problems can sometime result whereby production of the hydrocarbon fluids may be interrupted. Examples of such problems can typically result from severe weather conditions, wherein the ocean-going tanker cannot be made available to receive the produced hydrocarbon fluids. Another example of a problem which could cause the interruption of the production of hydrocarbon fluids would be labor problems which exist in some countries, whereby it might be difficult to obtain crews to operate the ocean-going tanker or shuttle tankers. Accordingly, in many instances, it is not only desirable, but necessary to have some storage device or facility associated with the offshore well, whereby the production of hydrocarbon fluids would not be interrupted due to severe weather conditions or labor problems.

Accordingly, prior to the development of the present invention, there has been no submersible production storage barge or method for transporting and installing a jack-up rig in a body of water, which: permits the jack-up rig and hydrocarbon fluid storage facility to be transported to the offshore site as a unit; prevents interruption of the production of hydrocarbon fluids during severe weather conditions or due to labor problems associated with the tanker to which the hydrocarbon fluids are being transferred; is easily assembled and economically used with reduced costs associated with attaching and rigging up the storage facility with the rig. Therefore, the art has sought a submersible production storage barge and method for transporting and installing a jack-up rig in a body of water, which: permits the hydrocarbon storage device and the jack-up rig to be transported to the offshore site as a single unit; prevents interruption of the production of hydrocarbon fluids during severe weather conditions or during labor problems associated with the tankers to which the hydrocarbon fluids are being transferred; and is easily assembled and economically used with reduced costs associated with attaching and rigging up the hydrocarbon storage facility with the rig.

SUMMARY OF THE INVENTION

In accordance with the invention, the foregoing advantages have been achieved through the present method for transporting and installing, in a body of water, a jack-up rig, having a hull and at least one jack-up leg. The present invention includes the steps of: associating a submersible production storage barge, having an upper wall surface, with the hull of the jack-up rig; moving the jack-up rig and submersible production barge to a desired site in the body of water, the jack-up rig being disposed above the upper wall surface of the submersible production storage barge while the jack-up rig and the submersible production storage barge are being moved; and lowering the at least one jack-up leg and the submersible production storage barge until they rest upon a surface below the body of water. A feature of the present invention is that the submersible production barge may be associated with the jack-up rig by passing the at least one jack-up leg through an opening formed in the submersible production storage barge and releasably securing the submersible production barge to the jack-up rig.

A further feature of the present invention is that while the jack-up rig and submersible production storage barge are being moved, the hull of the jack-up rig is disposed above the body of water and rests upon the upper wall surface of the submersible production storage barge, and flotation of the jack-up rig may be provided by the submersible production storage barge.

Another feature of the present invention is that ballast may be provided to the submersible production storage barge to make it slightly negatively buoyant prior to lowering the at least one jack-up leg; and supporting the submersible production storage barge by the at least one jack-up leg after the submersible production storage barge has become slightly negatively buoyant. A further feature of the present invention are the steps of further lowering the at least one jack-up leg and slightly negatively buoyant submersible production storage barge to a location intermediate an upper surface of the body of water and the surface below the body of water; and moving the jack-up rig and submersible production storage barge prior to lowering the at least one jack-up leg and submersible production storage barge until they rest upon the surface below the body of water.

In accordance with the invention, the foregoing advantages have also been achieved through the present submersible production storage barge adapted to be transported and installed in a body of water with a jack-up rig having a hull and at least one jack-up leg. The present invention includes a plurality of wall members defining at least one enclosed cavity for the storage of hydrocarbon fluids, the plurality of wall members forming an upper wall surface, a lower wall surface, and at least one side wall surface; and means for releasably securing the plurality of wall members to the jack-up rig while the jack-up rig is being transported to a site in the body of water, whereby the jack-up rig and plurality of wall members may be transported together to the site in the body of water, where the plurality of wall members may be lowered to rest upon a surface below the body of water.

A further feature of the present invention is that the releasable securing means may include at least one opening formed in the upper and lower wall surfaces and is adapted to permit passage of the at least one jack-up leg therethrough. A further feature of the present invention is that the releasable securing means may further include at least one stop member associated with the at least one opening, and is adapted to abut a portion of the at least one jack-up leg. Another feature of the present invention is that guide members may be associated with the at least one opening and are adapted to guide the at least one jack-up leg through the at least one opening as the plurality of wall members move with respect to the at least one jack-up leg. A further feature of the present invention is that the size of the at least one enclosed cavity defined by the plurality of wall members has enough buoyancy to provide flotation of the jack-up rig above the body of water when the hull of the jack-up rig rests upon the upper wall surface of the plurality of wall members.

The submersible production storage barge and method for transporting and installing a jack-up rig in a body of water of the present invention, when compared with previously proposed prior art hydrocarbon fluid storage devices and facilities and methods for transporting and installing a jack-up rig in a body of water, have the advantages of: permitting transportation of the jack-up rig and the hydrocarbon fluid storage facility as a unit to the offshore site; preventing interruption of the production of hydrocarbon fluids during severe weather conditions or during labor problems associated with tankers to which the hydrocarbon fluids are being transferred; and being easily assembled and economically used with reduced costs associated with attaching and rigging up the hydrocarbon storage facility with the jack-up rig.

While the invention will be described in connection with the preferred embodiment, it will be understood that it is not intended to limit the invention to that embodiment. On the contrary, it is intended to cover all alternatives, modifications, and equivalents as may be included within the spirit and scope of the present invention as defined by the appended claims.

DETAILED DESCRIPTION OF THE INVENTION

Figure 1:
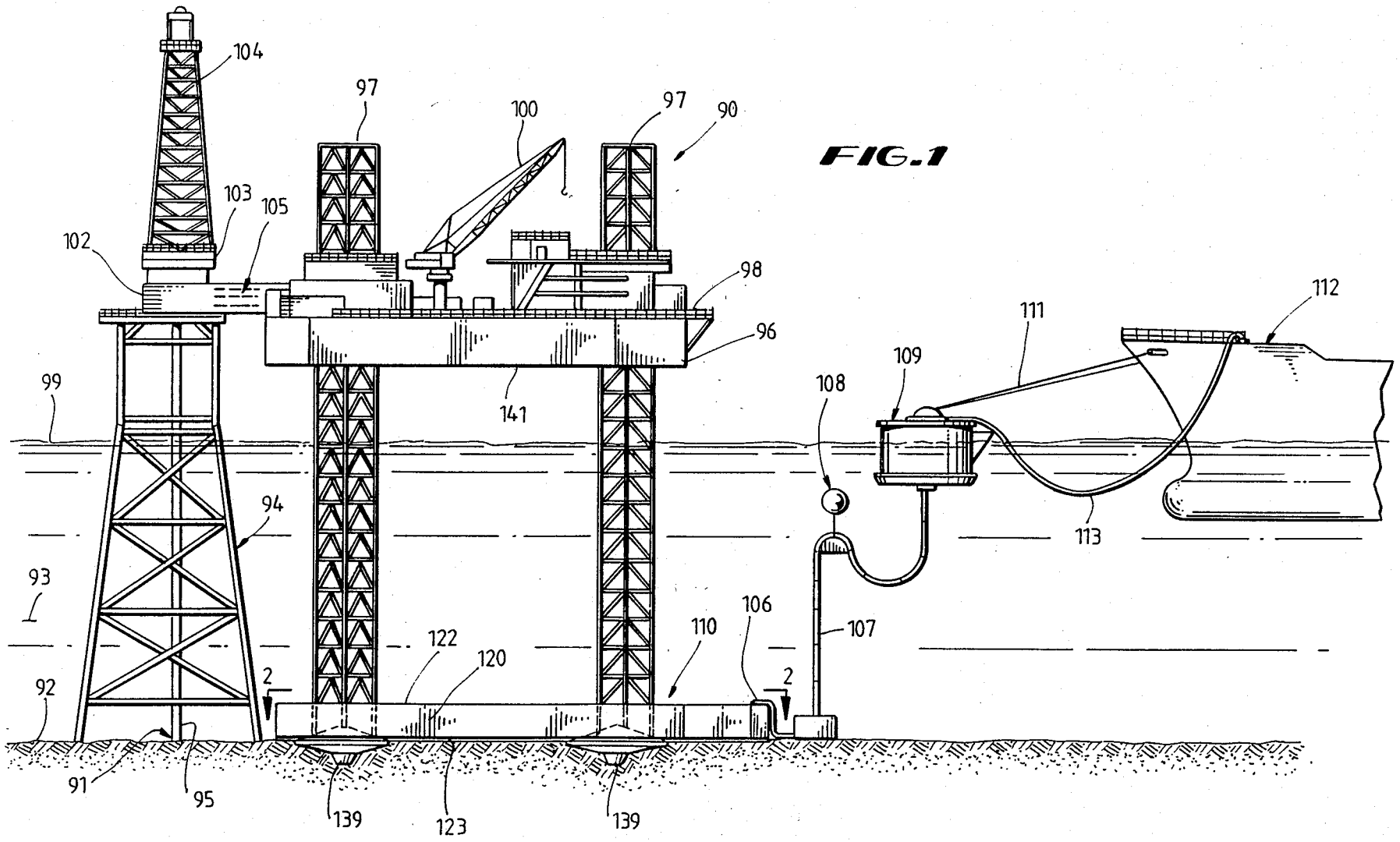
FIG. 1 is a elevation view of an offshore platform and a jack-up rig provided with the submersible production storage barge in accordance with the present invention.

In FIG. 1, a conventional jack-up rig 90 is illustrated and is provided with a submersible production storage barge 110 in accordance with the present invention. The jack-up rig 90 and submersible production storage barge 110 are shown in the positions they would be disposed with respect to one another when hydrocarbon fluid, such as oil, is being produced from well 91 disposed at the surface, such as ocean floor, 92 disposed beneath a body of water, or ocean or gulf, 93. The jack-up rig 90 is disposed adjacent a conventional offshore platform 94, and one or more conductors, or piping, 95 ascend from well 91 upwardly through offshore platform 94.

Still with reference to FIG. 1, the conventional jack-up rig 90 includes hull 96 and at least one, and preferably a plurality, of jack-up legs 97, which permit the hull 96 and working deck 98 to be raised above the water line 99 of ocean 93, as is conventional in the art. Jack-up rig 90 may include one or more cranes 100, a helideck 101, a cantilever beam 102 upon which drill floor 103 and derrick 104 are disposed, as is conventional in the art. Cantilever beam 102, with derrick 104 disposed thereon, is movable with respect to working deck 98 as is conventional in the art. As is also conventional in the art, jack-up rig 90 may be further provided with conventional equipment for drilling well 91, as well as for production of the hydrocarbon fluids therefrom, such as flares, scrubbers, survival craft, power generation devices (not shown) all of which are conventional in the art. Flow lines 105 are provided (dotted lines), as is conventional in the art, to communicate between the wellhead of well 91 and the working deck 98.

As shown in FIG. 1, as will be hereinafter described in greater detail, submersible production storage barge 110 has been disposed upon ocean floor 92 and is in fluid communication with flow lines 105 of jack-up rig 90, via conventional flow lines extending downwardly from the deck 98 of jack-up rig 90. Hydrocarbon fluids, or oil, may then be transferred from the submersible production storage barge 110 via a flow line, or flow lines, 106 in fluid communication with a flexible riser, or risers, 107 which are supported by a flexible riser float 108 which communicate with a mooring buoy 109.

Secured to the mooring buoy 109, via conventional mooring lines 111, is a tanker 112 such as a shuttle tanker, and conventional tanker fill lines 113 extend from the mooring buoy 109 to the shuttle tanker 112, as is conventional in the art.

Figure 2:
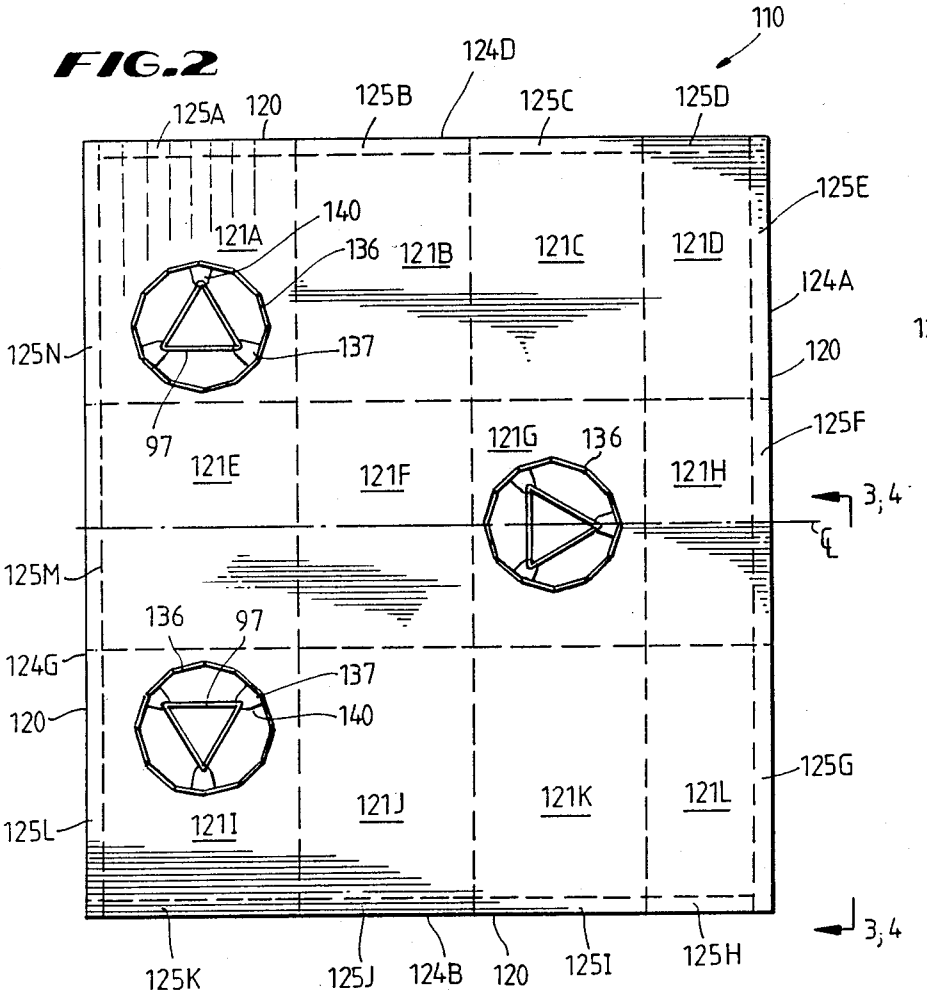
FIG. 2 is a top view of a submersible production storage barge in accordance with the present invention taken along line 2—2 of FIG. 1.

With reference now to FIGS. 2–4 and 6, the submersible production storage barge of the present invention will be described in greater detail. Submersible production storage barge 110 includes a plurality of wall members 120 which define at least one enclosed cavity, or storage tank, 121, and preferably a plurality of storage cavities or storage tanks 121 for the storage of hydrocarbon fluids (not shown). The design of the submersible production storage barge 110 of FIG. 2 is shown to include 12 enclosed cavities, or storage tanks, 121A–121L; however, as will be hereinafter apparent, the design of the submersible production storage barge could have a greater or fewer number of storage tanks 121 for the storage of hydrocarbon fluids.

The wall members 120 of the submersible production storage barge 110 form an upper wall surface 122, a lower wall surface 123, and at least one side wall surface 124. If the configuration of submersible production storage barge 110, when viewed from the top, as seen in FIG. 2, has a circular configuration, there would be only one side surface 124; however, as seen in FIG. 2, it is preferable that the configuration of the submersible production storage barge 110, as seen in FIG. 2, is either square or rectangular, wherein there are four side wall surfaces 124A–124D. The outer configuration of the submersible production storage barge 110, when viewed from the top as seen in FIG. 2, can of course be any configuration, the configuration being selected based upon considerations of strength, ease of manufacturing, and resistance to pressures exerted upon it by the water 93 as submersible production storage barge 110 is being towed, or is disposed upon the ocean floor 92, as illustrated in FIG. 1. The plurality of wall members 120 can be formed of any suitable material, such as steel plate and steel members, which have the requisite strength, characteristics, as is conventional in the art. A plurality of ballast tanks 125A–125N may be also provided about the outer periphery of submersible production storage barge 110, as seen in FIG. 2.

Figure 3:
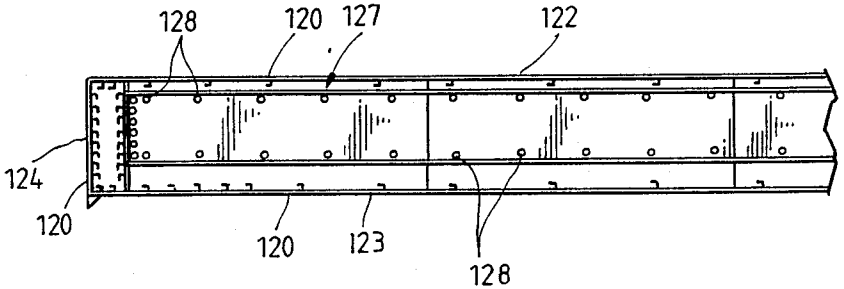
FIGS. 3 and 4 are partial cross-sectional views taken along lines 3—3 and 4—4 of FIG. 2.
Figure 4:
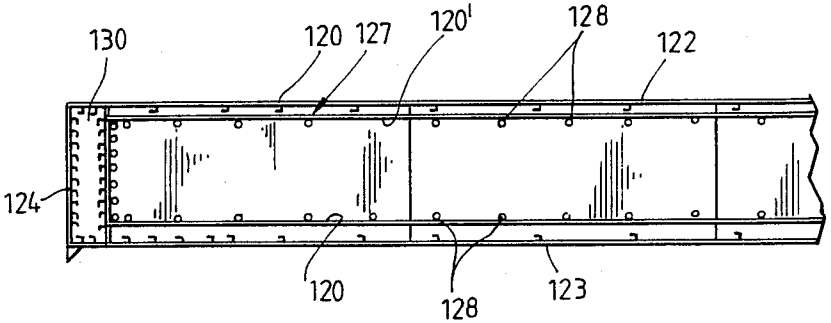

As seen in FIGS. 3 and 4, the submersible production storage barge 110 may be provided with a means for heating 127 the hydrocarbon fluids (not shown) contained in the at least one cavity, or storage tank, 121A–121L. Preferably, heating means 127 includes a plurality of interconnected pipes 128 which pass through all of the storage compartments 121A–121L, as well as the ballast tanks 125A–125N. Preferably hot water is circulated throughout piping 128 of heating means 127, insofar as the pour point of crude oil is approximately 90 degrees Fahrenheit, which is typically not the temperature of the submersible production storage barge 110, particularly when it is disposed upon the ocean floor 92 as illustrated in FIG. 1. Thus, heating means 127 assures that the hydrocarbon fluids may be readily transferred from the submersible production storage barge 110, through the previously described risers 107 and fill lines 113 to tanker 112. Conventional flow lines (not shown) may extend downwardly from the work deck 98 of jack-up rig 90 to a suitable, conventional connection with piping 128 of heating means 127, in order to provide the necessary heating medium, such as hot water. In this regard, it should be noted that other heating mediums or fluids, other than hot water, such as steam, could be used to circulate through piping 128 of heating means 127.

FIG. 3 illustrates an embodiment of submersible production storage barge 110, wherein a single wall construction is utilized for the submersible production storage barge 110. In the embodiment of FIG. 3, a single wall member 120 is disposed between the at least one enclosed cavity 121A–121L and the body of water, or ocean, 93. Thus, the storage tanks 121A–121L take up the entire enclosed space between the wall members 120 which form the top surface 122 and bottom surface 123, and bounded by the at least one side wall surface 124.

In the embodiment of submersible production storage barge 110 of FIG. 4, outer wall members 120 which form the upper wall, lower wall, and side wall surfaces 122,123,124, are spaced apart from a plurality of inner wall members 120' and the outer and inner wall members 120' are disposed between the at least one enclosed cavity, or storage tanks 121A–121L, and the body of water 93, whereby an enclosed space 130 is defined by the outer and inner wall members 120,120'. Insulation of a conventional type may be disposed within cavity 130, which coupled with heating means 128, helps to insure that the hydrocarbon fluids stored within the submersible production storage barge 110 may be readily transferred therefrom to tanker 112. The double wall construction described in connection with FIG. 4 is particularly useful when the submersible production storage barge 110 is used at a location where the ambient temperature of the water 93 is particularly cold.

Figure 6:
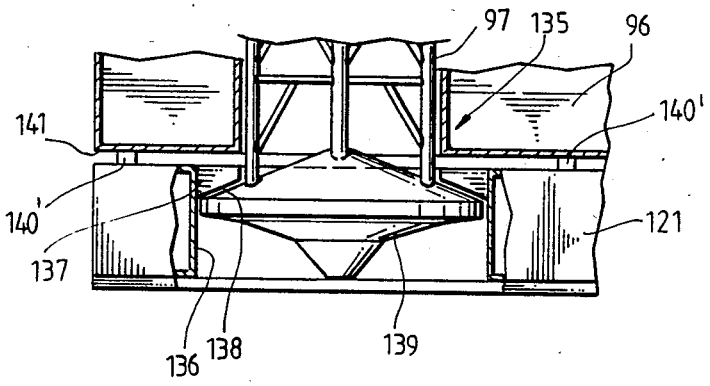
FIG. 6 is an enlarged, partial cross-sectional view of a portion of the submersible production storage barge in accordance with the present invention.

With reference now to FIGS. 2 and 6, it is seen that submersible production storage barge 110 is provided with a means for releasably securing 135 the plurality of wall members 120 to the jack-up rig 90, while the jack-up rig 90 is being transported to a site in the body of water 93, as will be hereinafter described in greater detail. Releasable securing means 135 permits the jack-up rig 90 and the plurality of wall members 120, which form the submersible production storage barge 110, to be transported together as a unit to the desired site in the body of water 93. Releasable securing means 135 may comprise any suitable device or structure having the requisite strength characteristics to releasably connect the submersible production storage barge 110 to jack-up rig 90 while they are both being transported to the desired site in the body of water 93, provided during such transportation, the jack-up rig 90 is disposed above the upper wall surface 122 of submersible production storage barge 110. In this regard, it should be noted that the term jack-up rig 90 could also encompass a semi-submersible rig which could be provided with a submersible production storage barge 110 of the present invention, provided the semi-submersible rig has the submersible production storage barge 110 of the present invention releasably secured below the semi-submersible rig during the transportation of the semi-submersible rig and the submersible production storage barge 110 to the desired site in the body of water 93.

Preferably, releasable securing means 135 includes at least one opening 136 formed in the upper and lower wall surfaces 122,123 of submersible production storage barge 110 and the at least one opening 136 is adapted to permit the passage of the at least one jack-up leg 97 to pass through the at least one opening 136. Releasable securing means 135 may further include at least one stop member 137 associated with the at least one opening 136, the at least one stop member 137 being adapted to abut a portion of the at least one jack-up leg 90. Preferably, two or more stop members are provided for each opening 136, three stop members 137 being used for each opening 136, as seen in FIG. 2. As seen in FIG. 6, the portion 138 of the lower end of jack-up leg 97 which is abutted by stop member 137 is the upper surface of a conventional spud can, or spud tank 139, which is disposed at the lower end of jack-up leg 97 in a conventional manner. As seen in FIG. 2, a portion of each stop member 137 also forms a guide member 140, the guide members 140 being adapted to guide the at least one jack-up leg 97 through the at least one opening 136 as the plurality of wall members 120, which form the submersible production storage barge 110, are moved with respect to the at least one jack-up leg 97, as will be hereinafter described in further detail.

Figure 5:
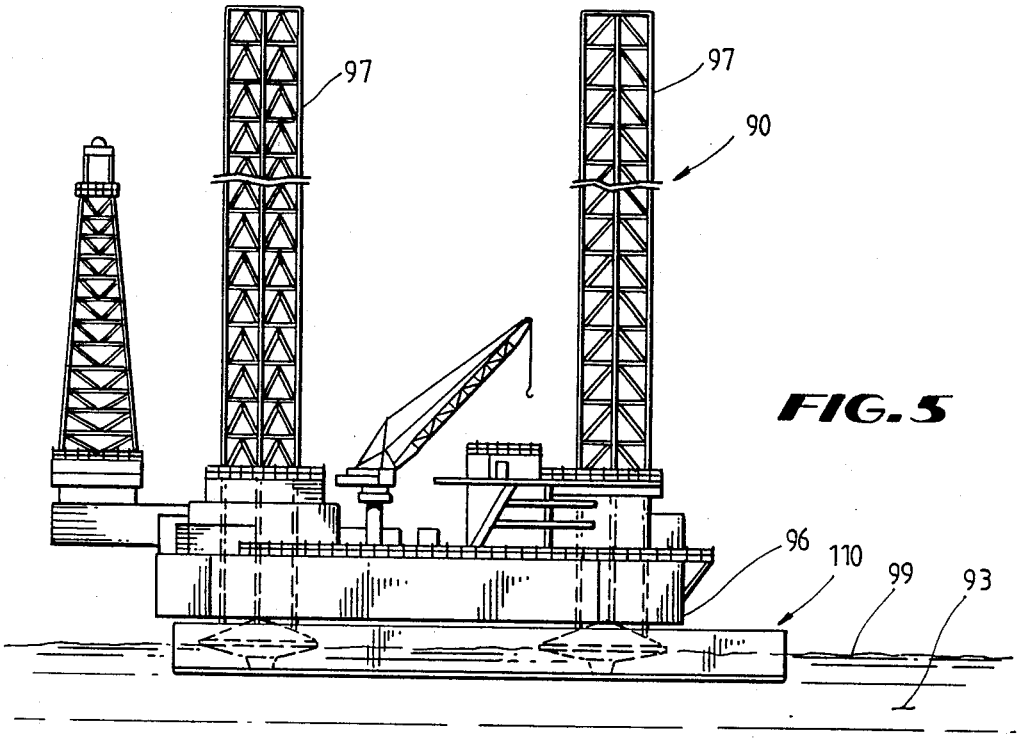
FIG. 5 is a elevation view of a jack-up rig and a submersible production storage barge in accordance with the present invention, illustrating them being transported to an offshore site.

As seen in FIGS. 5 and 6, when jack-up legs 97 are in their completely retracted position, as during transportation of the jack-up rig 90 and submersible production storage barge 110, as will be hereinafter described in greater detail, the submersible production storage barge 110 is releasably secured to the hull 96 of jack-up rig 90. This releasable connection is due to the abutting between stop members 137 and the upper surface 138 of spud can, or spud tank, 139 fixedly secured to the lower end of jack-up leg 97, whereby the weight of submersible production storage barge 110 is supported by jack-up leg 97 via the contact of stop member 137 with the upper surface 138 of spud can or spud tank 139. If desired, conventional cribbing, or a framework of timber, 140' may be disposed between the upper wall surface 122 of submersible production storage barge 110 and the bottom surface 141 of jack-up rig hull 96.

As seen in FIG. 5, and as will be hereinafter described in further detail, when the jack-up rig 90 and submersible production storage barge 110 are being transported to the desired site within the body of water 93, jack-up rig 90 rests upon the upper surface 122 of submersible production storage barge 110, as previously described, and the jack-up rig 90 is supported thereby above the body of water 93. Accordingly, the submersible production storage barge 110 preferably has enough buoyancy to provide flotation of the jack-up rig 90 in the manner previously described. Thus, the size of the at least one enclosed cavity, or storage tanks 121A–121L, defined by the plurality of wall members 120 which form the submersible production storage barge 110 must provide the necessary buoyancy and flotation to support the weight of the jack-up rig 90 upon the body of water 93. It should be noted that dependent upon the configuration of the jack-up rig 90, and the size of the submersible production storage barge 110, releasable securing means 135 could comprise a plurality of annular guide members fixedly secured to the at least one side surface 124, or 124A–124D, which annular guide members are disposed about the jack-up legs 97 in a manner similar to that illustrated in FIGS. 1 and 2, wherein the jack-up legs 97 pass through the at least one opening 136 formed in the submersible production storage barge 110. Such annular guide members (not shown) could further include the previously described stop member 137 and guide member 140.

Figure 7:
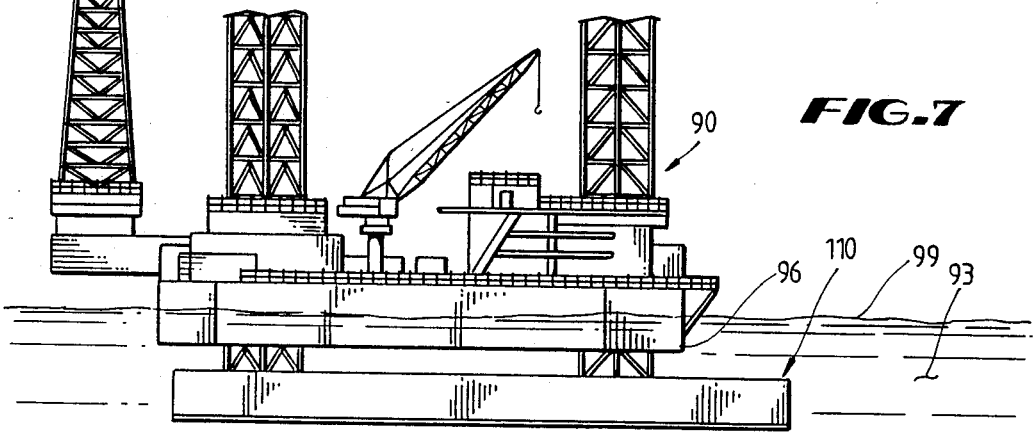
FIG. 7 is a elevation view of a jack-up rig and a submersible -production storage barge in accordance with the present invention, illustrating the relationship with one another when they are being towed together a short distance.
Figure 8:
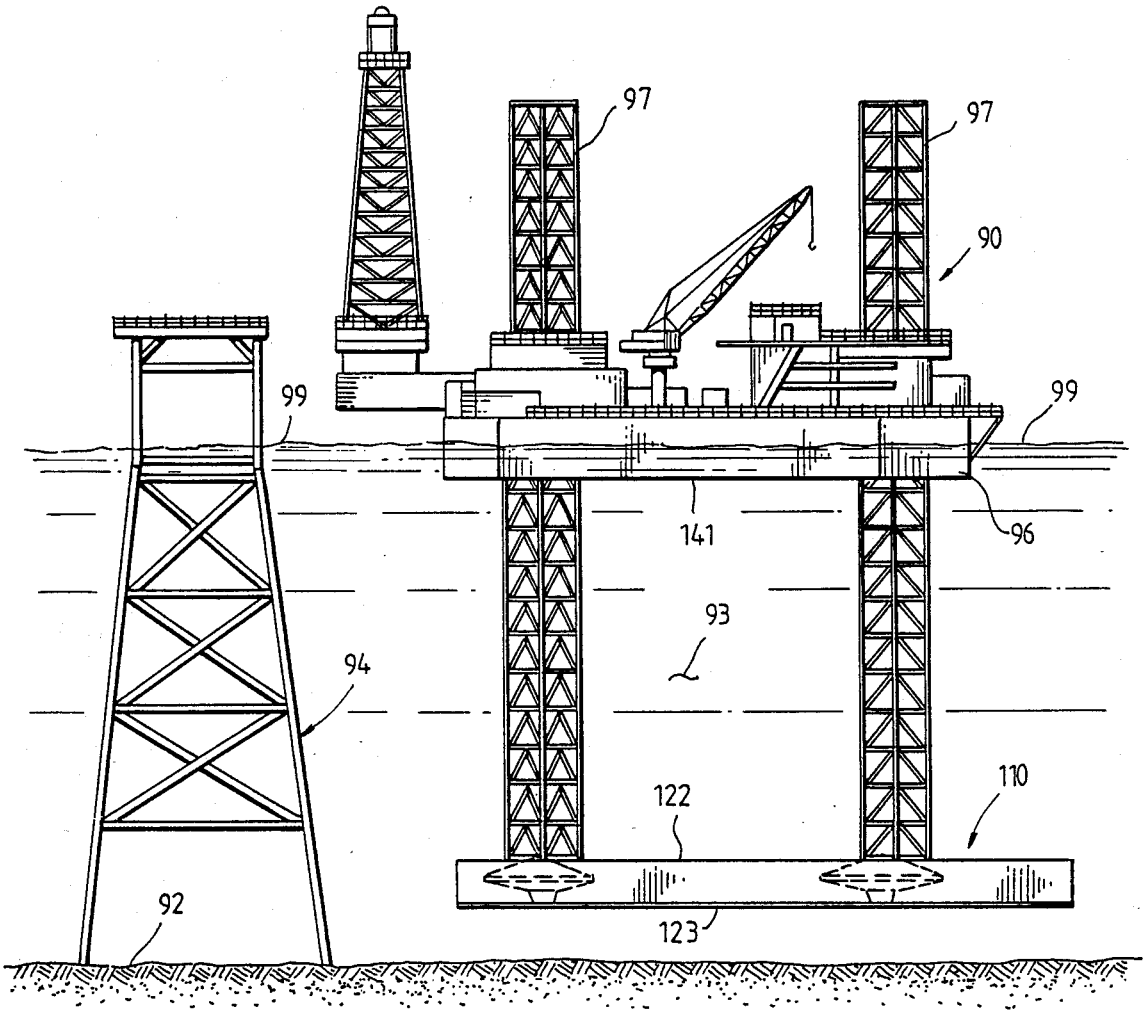
FIG. 8 illustrates a jack-up rig and submersible production storage barge in accordance with the present invention, as the submersible production storage barge is being lowered to rest upon a surface below a body of water.

With reference now to FIGS. 5, 7 and 8, the method of the present invention for transporting and installing, in a body of water 93, jack-up rig 90 will be described. Initially, as shown in FIG. 5, a submersible production storage barge 110, such as that previously described herein, is associated with the hull 96 of jack-up rig 90. Jack-up rig 90 and submersible production storage barge 110 may then be moved to a desired site in the body of water 93, wherein the jack-up rig 90 is disposed above the upper wall surface 122 of the submersible production storage barge 110, while the jack-up rig 90 and the submersible production storage barge 110 are being moved, as illustrated in FIG. 5. After the associated, or releasably connected submersible production storage barge 110 and jack-up rig 90 have reached the desired site in the body of water 93, the legs 97 of the jack-up rig 90 and the submersible production storage barge 110 are lowered until they rest upon a surface, or ocean floor 92 below the body of water 93, and assume the position shown in FIG. 1. Preferably, the jack-up leg and submersible production storage barge 110 are simultaneously lowered together. FIG. 8 illustrates the disposition of submersible production storage barge 110 as it is being lowered to rest upon the ocean floor 92. Preferably, the submersible production storage barge 110 and jack-up rig 90 are moved to the desired site in the body of water 93 by conventional oceangoing tugs (not shown). Preferably, the submersible production storage barge 110 is associated with, or releasably secured to, the jack-up rig 90 by passing the leg, or legs, 97 of the jack-up rig 90 through an opening, or openings, 136 formed in the submersible production storage barge 110 as previously described in connection with FIGS. 2 and 6.

As seen in FIG. 5, while the jack-up rig 90 and submersible production storage barge 110 are being moved, the hull of the jack-up rig 90 is preferably disposed above the body of water 93 and rests upon the upper wall surface 122 of the submersible production storage barge 110, flotation of the jack-up rig 90 being provided by the submersible production storage barge 110 as previously described.

Preferably, the submersible production storage barge 110 is initially associated with the jack-up rig 90 by first floating the jack-up rig over the submersible production storage barge 110. The submersible production storage barge 110 is sufficiently ballasted, as by filling ballast tanks 125A–125N, in an amount sufficient enough so that the submersible production storage barge 110 is disposed beneath the water line 99 and there is sufficient clearance between the submersible production storage barge 110 and the jack-up rig 90, when the jack-up rig 90 is floated to a position disposed above the submersible production storage barge 110. The legs 97 of jack-up rig 90 may then be stabbed through the openings 136 formed between the upper and lower wall surfaces 122,123 of submersible production storage barge 110. After the jack-up legs 97 have been stabbed through the openings 136, the stop members and guide members 140, as previously described in connection with FIGS. 2 and 6, may be fixedly secured and associated with openings 136 of submersible production storage barge 110 in the manner previously described in connection with FIGS. 2 and 6. The ballast, or sea water, contained within ballast tanks 125A–125N may then be pumped out, whereby the jack-up rig 90 and the submersible production storage barge 110 will assume the disposition shown in FIG. 5, whereby it may then be towed to the desired site in the body of water 93 as previously described.

Preferably, prior to lowering the jack-up legs 97, as shown in FIG. 8, ballast, or sea water, is provided to the ballast tanks 125A–125N to make the submersible production storage barge 110 slightly negatively buoyant. Ballast may also be supplied to one or more of the centrally located storage tanks, such as tanks 121F and 121G, to assit in achieving this slightly negatively buoyant condition. The submersible production storage barge 110 will then be supported by the jack-up legs 97, such as by the weight of the submersible production storage barge 110 resting upon the spud can, or spud tank, 139 via stop members 137, as previously described in connection with FIG. 6. Preferably, while the submersible production storage barge 110 is slightly negatively buoyant, as previously described, the jack-up legs 97 and the slightly negatively buoyant submersible production storage barge 110 are lowered to a location intermediate the water line 99 and the ocean floor 92 as illustrated in FIG. 7. Preferably, the submersible production storage barge 110 is lowered a distance of from 10 to 50 feet. As seen in FIG. 7, flotation for the submersible production storage barge 110 and the jack-up rig 90 is provided solely by the hull 96 of the jack-up rig 90.

When the submersible production storage barge 110 and jack-up rig 90 are disposed in the manner described in connection with FIG. 7, the jack-up rig 90 is relatively stable, and may be easily towed short distances when the submersible production storage barge 110 is disposed in the intermediate position shown in FIG. 7. For example, for moving submersible production storage barge 110 and jack-up rig 90 across an ocean, as for example from the United States to New Zealand, it would be preferable to have the jack-up rig 90 and submersible production storage large 110 disposed in the position shown in FIG. 5. Once the jack-up rig 90 and submersible production storage barge 110 have reached the distant location, and are disposed in shallow water, such as in a harbor, it is preferable that the submersible production storage barge 110 be lowered to the position shown in FIG. 7, as previously described, before towing the jack-up rig 90 and submersible production storage barge 110 to the final site, or offshore platform 94. It should be noted that due to the "free surface effect", or "loss of free surface area" occurring as the submersible production storage barge 110 is initially lowered from the position shown in FIG. 5 to the position shown in FIG. 7 the jack-up rig 90 and submersible production storage barge 110 encounters some instability, as is well known in the art; however, the cooperation between jack-up legs 97 and guide members 140 helps to maintain the stability of the jack-up rig 97 and the submersible production storage barge 110, until the submersible production storage barge 110 is lowered into the position shown in FIG. 7.

After the jack-up rig 90 and the submersible production storage barge 110 have arrived at the offshore platform 94, or other desired site in ocean 93, the jack-up legs 97 and the submersible production storage barge 110 are lowered as shown in FIG. 8, until the submersible production storage barge 110 rests upon ocean floor 92, and jack-up legs 97 are spudded into ocean floor 92 in a conventional manner, as shown in FIG. 1. When submersible production storage barge 110 is resting upon ocean floor 92, it is only supporting its own weight, and all of the weight of the jack-up rig 90 is supported by the jack-up legs 97 via spud cans, or spud tanks, 139. After jack-up legs 97 are resting upon ocean floor 92, the hull 96 of jack-up 90 is elevated in a conventional manner until it is in the position shown in FIG. 1. Preferably, after submersible production storage barge 110 is resting upon ocean floor 92, ballast tanks 125A–125N, as well as storage tank 121F and 121G may be flooded to maximize the bottom weight of the submersible production storage barge 110. In this regard, flow lines are preferably provided into the submersible production storage barge 110 from the jack-up rig 90 to provide the ballast material. Additional flow lines from the jack-up rig 97 to the submersible production storage barge 110 are provided to transfer the hydrocarbon fluids to the submersible production storage barge 110.

Additionally, additional flow lines may be provided from jack-up rig 90 via jack-up leg 97 into submersible production storage barge 110 to provide fluid, such as air, to remove the ballast material from the submersible production storage barge 110, when it is desired to retrieve the submersible production storage barge 110 and remove the jack-up rig 90 from its location and move it to another desired location. As previously described in connection with FIG. 1, at least one fluid transfer device, or flexible risers 107 and mooring buoy 109, as previously described in connection with FIG. 1, may be associated with the submersible production storage barge 110 whereby stored hydrocarbon fluids may be transferred from the submersible production storage barge 110 to tanker 112 by use of the fluid transfer device, or flexible risers 107, mooring buoy 109, and tanker fill lines 113.

It is to be understood that the invention is not limited to the exact details of construction, operation, exact materials or embodiments shown and described, as obvious modifications and equivalents will be apparent to one skilled in the art. For example, the submersible production storage barge 110 could be associated with a semi-submersible rig, as by releasably securing the submersible production storage barge beneath, and to, a semi-submersible rig by a plurality of anchor cables, while the semi-submersible rig and submersible production storage barge are transported to the desired location. Accordingly, the invention is therefore to be limited only by the scope of the appended claims.

I claim:

1. A method for transporting and installing, in a body of water, a jack-up rig, having a hull and a plurality of jack-up legs, comprising the steps of:

(a) associating a submersible production storage barge, having an upper wall surface, with the hull of the jack-up rig;

(b) passing the plurality of jack-up legs through openings formed in the submersible production storage barge and releasably securing the submersible production storage barge to the jack-up rig;

(c) moving the jack-up rig and submersible production storage barge to a desired site in the body of water, the jack-up rig being disposed above the upper wall surface of the submersible production storage barge while the jack-up rig and the submersible production storage barge are being moved; and (d) lowering the plurality of jack-up legs and the submersible production storage barge until they rest upon a surface below the body of water.

2. The method of claim 1, wherein while the jack-up rig and submersible production storage barge are being moved, the hull of the jack-up rig is disposed above the body of water and rests upon the upper wall surface of the submersible production storage barge, and flotation of the jack-up rig is provided by the submersible production storage barge.

3. The method of claim 1, including the steps of providing ballast to the submersible production storage barge to make it slightly negatively buoyant prior to lowering the plurality of jack-up legs; and supporting the submersible production storage barge by the plurality of jack-up legs after the submersible production storage barge has become slightly negatively buoyant.

4. The method of claim 3, including the steps of further lowering the plurality of jack-up legs and slightly negatively buoyant submersible production storage barge to a location intermediate an upper surface of the body of water and the surface below the body of water; and moving the jack-up rig and submersible production storage barge, prior to lowering the plurality of jack-up legs and submersible production storage barge until they rest upon the surface below the body of water.

5. The method of claim 1, including the step of flooding at least a portion of the submersible production storage barge after it has been lowered to rest upon the surface below the body of water.

6. The method of claim 1 including the step of storing hydrocarbon fluids within the submersible production storage barge, after the submersible production storage barge rests upon the surface below the body of water.

7. The method of claim 6, including the step of associating at least one fluid transfer device with the submersible production storage barge and transferring the stored hydrocarbon fluids from the submersible production storage barge to a tanker by use of the fluid transfer device.

8. A submersible production storage barge, adapted to be transported and installed in a body of water with a jack-up rig having a hull and a plurality of jack-up legs comprising:

(a) a plurality of wall members defining at least one enclosed cavity for the storage of hydrocarbon fluids, the plurality of wall members forming an upper wall surface, a lower wall surface, and at least one side wall surface; and (b) means for releasably secured the plurality of wall members to the jack-up rig while the jack-up rig is being transported to a site in the body of water, whereby a jack-up rig and plurality of walls members may be transported together to the site int he body of water, the releasable securing means including a plurality of openings formed in the upper and lower wall surfaces through while the plurality of jack-up legs pass through, where the plurality of wall members may be lowered to rest upon a surface below the body of water.

9. The submersible production storage barge of claim 8, including means for heating hydrocarbon fluids to be contained in the at least one cavity.

10. The submersible production storage barge of claim 9, wherein the heating means includes a plurality of pipes disposed within the at least one cavity, the plurality of pipes adapted to contain a high temperature fluid.

11. The submersible production storage barge of claim 8, wherein the releasable securing means further includes at least one stop member associated with the at least one opening, and is adapted to abut a portion of the at least one jack-up leg.

12. The submersible production storage barge of claim 11, including guide members associated with the at least one opening and adapted to guide the at least one jack-up leg through the at least one opening as the plurality of wall members move with respect to the at least one jack-up leg.

13. The submersible production storage barge of claim 8, wherein a single wall member is disposed between the at least one enclosed cavity and the body of water.

14. The submersible production storage barge of claim 8, wherein two wall members, spaced apart from one another to define an enclosed space, are disposed between the at least one enclosed cavity and the body of water.

15. The submersible production storage barge of claim 14, wherein insulation is disposed in the enclosed space between the two wall members.

16. The submersible production storage barge of claim 8, wherein the size of the at least one enclosed cavity defined by the plurality of wall members has enough buoyancy to provide flotation of the jack-up rig above the body of water when the hull of the jack-up rig rests upon the upper wall surface of the plurality of wall members.

* * * * *

UNITED STATES PATENT AND TRADEMARK OFFICE

CERTIFICATE OF CORRECTION

PATENT NO. : 4,907,912

DATED : March 13, 1990

INVENTOR(S) : Marvin L. Smith

It is certified that error appears in the above-identified patent and that said Letters Patent is hereby corrected as shown below:

Col. 1, line 18, "bankers" should read --tankers--.

Signed and Sealed this

Twenty-ninth Day of January, 1991

*Attest:*

HARRY F. MANBECK, JR.

*Attesting Officer*

*Commissioner of Patents and Trademarks*